US007237354B1

(12) United States Patent
Conner

(10) Patent No.: US 7,237,354 B1
(45) Date of Patent: Jul. 3, 2007

(54) GUN MAGAZINE WITH TWO-STAGE SPRING

(76) Inventor: Kenneth Conner, 1032 Walden Ct., Bolingbrook, IL (US) 60440

( * ) Notice: Subject to any disclaimer, the term of this patent is extended or adjusted under 35 U.S.C. 154(b) by 0 days.

(21) Appl. No.: 10/775,630

(22) Filed: Feb. 10, 2004

Related U.S. Application Data

(60) Provisional application No. 60/446,962, filed on Feb. 12, 2003.

(51) Int. Cl.
*F41A 9/61* (2006.01)

(52) U.S. Cl. ..... 42/50; 42/49.02; 224/931

(58) Field of Classification Search ..... 42/50, 42/49.02; 224/931; 89/197, 33.1
See application file for complete search history.

(56) References Cited

U.S. PATENT DOCUMENTS 3,772,812 A * 11/1973 Day ..... 42/7
5,386,657 A * 2/1995 Racheli ..... 42/50
5,704,148 A * 1/1998 Valorose ..... 42/50
5,755,052 A * 5/1998 Keeney ..... 42/50

* cited by examiner

*Primary Examiner*—M. Clement
(74) *Attorney, Agent, or Firm*—Welsh & Katz, Ltd.

(57) ABSTRACT

An ammunition clip is provided for supplying cartridges to a firearm. The ammunition clip includes an elongated housing having an internal chamber for holding a plurality of laterally aligned cartridges, said elongated housing having a loading end and an opposing end, a movable carriage disposed within the internal chamber for urging the aligned cartridges towards the loading end and a spring that urges the movable carriage towards the loading end, said spring being disposed completely outside the internal chamber, said spring being coupled on a first end to the elongated housing and on a second end to the movable carriage and being operatable in a direction of spring pressure that is parallel to a longitudinal axis of the longitudinal housing.

7 Claims, 5 Drawing Sheets

GUN MAGAZINE WITH TWO-STAGE SPRING

This application is a continuation-in-part of U.S. Provisional Patent No. 60/446,962 filed on Feb. 12, 2003.

FIELD OF THE INVENTION

The field of the invention relates to firearms and more particularly to ammunition clips for firearms.

BACKGROUND OF THE INVENTION

Ammunition clips (magazines) for firearms are widely used. Such clips often hold large numbers of cartridges and are often associated with automatic and semi-automatic weapons. The ease and speed with which an empty clip can be replaced with a full clip makes the use of ammunition clips very popular with the police, the armed forces and gun hobbyists, in general.

Gun clips are typically constructed with an elongated housing with one end of the housing engaging the gun and the other, lower end extending downward. The lower end is frequently used as a handle.

Cartridges are typically loaded from the gun end and are usually inserted cross-wise to the elongation of the housing. A spring underneath the cartridges is compressed by insertion of each cartridge and functions to urge the loaded cartridges towards the gun breech during firing.

While existing gun clips work well, their spring mechanisms are unnecessarily complex. In order to maximize the number of cartridges that a clip holds, the spring is required to have a very low profile and to occupy a relatively small volume at the bottom of the clip when the clip is full loaded. Because of the importance of gun clips a need exists for a more space efficient spring mechanism.

SUMMARY

An ammunition clip is provided for supplying cartridges to a firearm. The ammunition clip includes an elongated housing having an internal chamber for holding a plurality of laterally aligned cartridges, said elongated housing having a loading end and an opposing end, a movable carriage disposed within the internal chamber for urging the aligned cartridges towards the loading end and a spring that urges the movable carriage towards the loading end, said spring being disposed completely outside the internal chamber, said spring being coupled on a first end to the elongated housing and on a second end to the movable carriage and being operatable in a direction of spring pressure that is parallel to a longitudinal axis of the longitudinal housing.

DETAILED DESCRIPTION OF AN ILLUSTRATED EMBODIMENT

Figure 1:
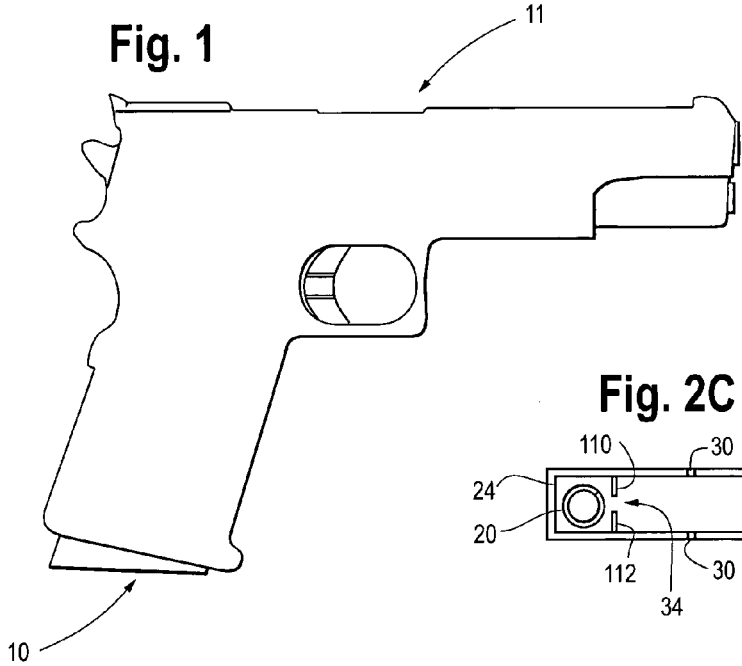
FIG. 1 is a side view of a handgun and ammunition clip in accordance with an illustrated embodiment of the invention.

FIG. 1 is a side view of a handgun 11 with ammunition magazine (clip) 10 shown generally under an illustrated embodiment of the invention. While FIG. 1 shows the clip 10 in conjunction with a handgun 11, it should be understood that the clip 10 may be used with a rifle or any other type of firearm.

Figure 2C:
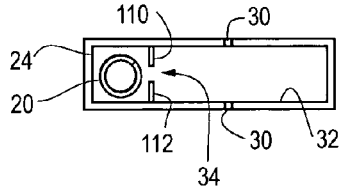
FIGS. 2A–C depict right side, left side and top cut-away views of the ammunition clip of FIG. 1 in a fully loaded and in an empty configuration.
Figure 2A:
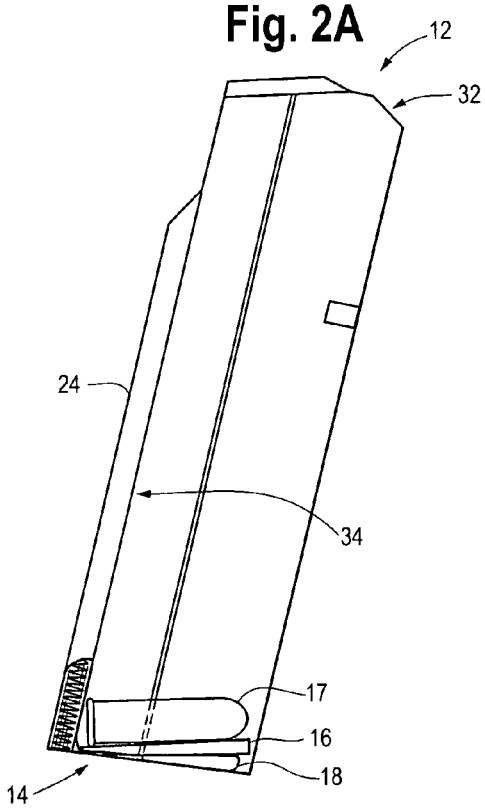
Figure 2B:
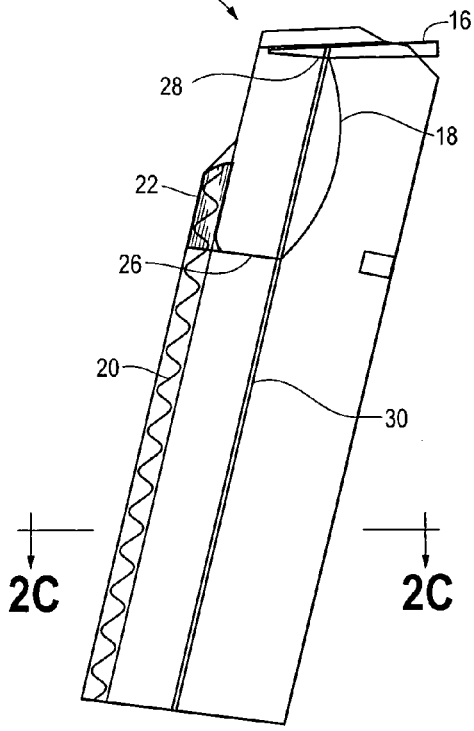

FIGS. 2*a–b* is a cut-away side view of the clip 10 of FIG. 1. FIG. 2*a* shows the clip 10 as it would appear when loaded with cartridges. FIG. 2*b* shows the clip 10 as it would appear when empty. As shown in FIGS. 2*a–b*, the clip 10 has an elongated housing 12 that, engages with a firearm at a loading end (top of FIGS. 2*a–b*) and extends downwards away from the breech of the gun towards an opposing end.

In the case of the handgun 11 of FIG. 1, the clip 10 may fit entirely within the handle of the handgun 11. Within the clip 10 is an internal chamber 32 for ammunition (one cartridge 17 shown within the internal chamber 32.

Included within the clip 10 may be a moveable carriage (also commonly referred to as a follower) 16 that (as cartridges are removed from the clip 10 by operation of the gun 11 or other wise) moves upwards under the influence of a pair of resilient members (springs) 18, 20 and a spring follower slide 22. The carriage 16 may be provided with a flat (or curved) upper surface (in contact with the cartridges) and a recess on the lower surface to receive the spring 18.

The elongated housing 12 may include a pair of slots 30 in the opposing side walls that extend parallel to a longitudinal axis of the longitudinal housing 12, as shown in FIG. 1. A transverse pin 28 may extend through the movable carriage 16 and engage the slots 30 on opposing sides.

The first spring 20 and second spring 18 may operate through a spring follower slide 22 to urge the movable carriage 16 upwards towards the breech of the gun 11. The slide 22 may engage and operate within a third longitudinal slot 34 extending along an edge of the longitudinal housing 12.

Figure 6B:
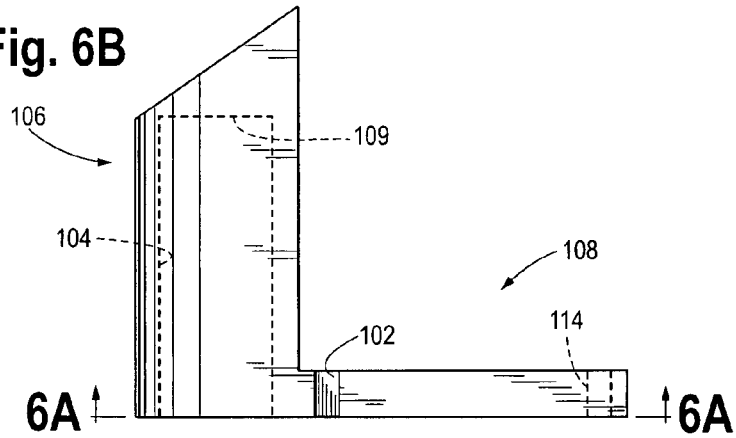
FIGS. 6*a–b* depicts a slide that may be used by the slip of FIGS. 2*a–b* and 3*a–b;*
Figure 6A:
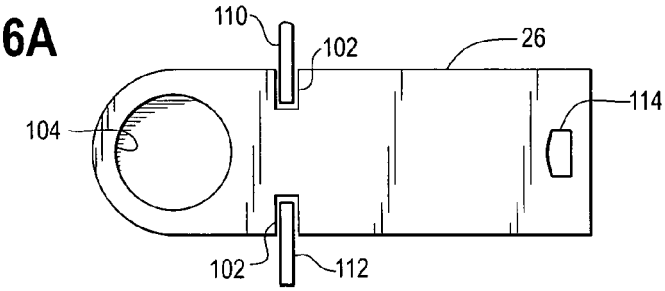

FIGS. 6*a–b* shows a bottom view and side view of the slide 22. As shown in FIG. 6, the slide 22 may have a pair of complementary slots 102 that engage opposite sides 110, 112 of the slot 34 in the elongated housing 12.

The slide 22 may extend through the vertical slot 34 in the end wall of the elongated enclosure 12 with a first end 106 of the slide 22 being disposed in a slide enclosure 24 and a second end 108 (horizontal extension 26) extending into the internal chamber 32. Within the internal chamber 32, a first spring 18 of the pair of springs 18, 20 may be coupled between the horizontal extension 26 of the slide 22 and the movable carriage 16.

The first spring 18 may be leaf spring with a first end of the leaf spring 18 looped around the transverse pin 28. A second end of the leaf spring may be looped around an end of the horizontal member 26 through an aperture 114.

Also included within the slide enclosure 24 may be a second spring 20 of the pair of springs 18, 20. The spring 20 may be a coil-type compression spring. A first end of the second spring 20 may be inserted into a spring recess 104 of the slide 22. A second end of the spring 20 may extend to the bottom of the slide enclosure 24.

As shown in FIG. 2*a* when the clip 10 is fully loaded, the second spring 20 is fully compressed and is substantially contained within the spring recess 104. Compression of the spring 20 into the recess 104 allows the slide 22 to descend substantially to the bottom of the clip 10.

Also, as the clip 10 is fully loaded, the leaf spring 18 folds onto itself to occupy a very small area beneath the movable carriage 16 and cartridges 17 (as shown in FIG. 2*a*). The combination of the first and second springs 18, 20 and slide 22 allows the clip 10 to be substantially fully loaded with cartridges 17 without any wasted space at the bottom of the clip 10 that would otherwise be occupied by the spring in a compressed state.

As shown in FIG. 2*b*, as the cartridges 17 are removed, the springs 18, 20 begin to extend. The primary spring 20 may begin to extend first due to a greater spring constant. As the slide 22 reaches its upper limit of travel, the weight of the cartridges decreases and the secondary spring 18 may complete the process of urging the movable carriage 16 towards the breech to discharge the remaining few cartridges 17.

In another embodiment (shown in FIGS. 3*a*–*b*), the slide 22 is turned upside down and a tension (e.g., a coil) spring 50 is used within the clip 10. In this case, a first end of the tension spring 50 is attached to a top 52 of the slide enclosure 24 and a second end of the spring 50 is attached to a top end 119 of the slide 22.

Figure 3A:
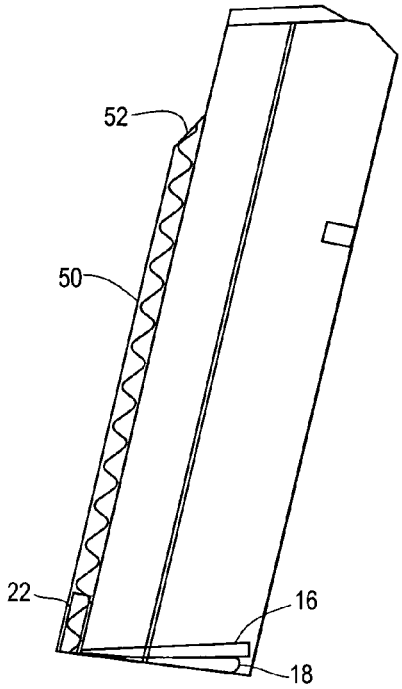
FIGS. 3*a–b* depict an alternate embodiment of the ammunition clip of FIG. 1 in a fully loaded and in an empty configuration.
Figure 3B:
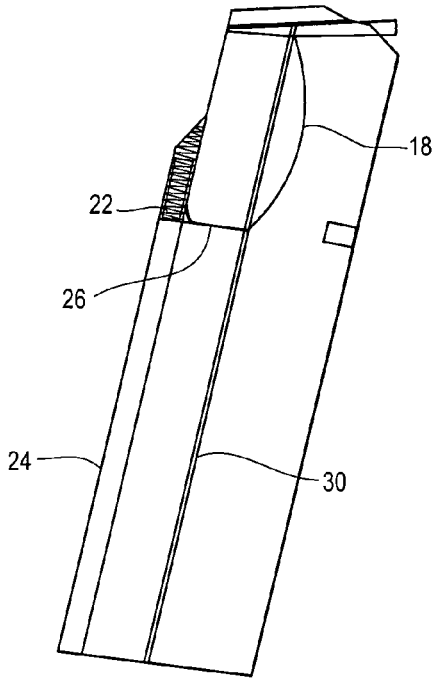

In the case of FIGS. 3*a*–*b*, loading cartridges 17 into the clip 10 causes the spring 50 to be subject to tensile forces that causes the spring 50 to extend towards the bottom of the clip 10. As cartridges are removed, the primary spring 50 and the secondary spring 18 operates substantially as described above.

Figure 4A:
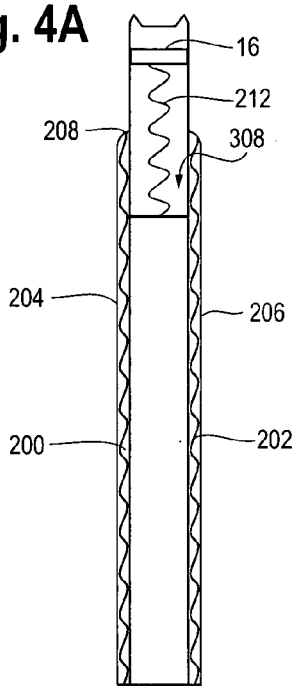
FIGS. 4*a–b* depict another alternate embodiment of the ammunition clip of FIG. 1 in a fully loaded and in an empty configuration.
Figure 4B:
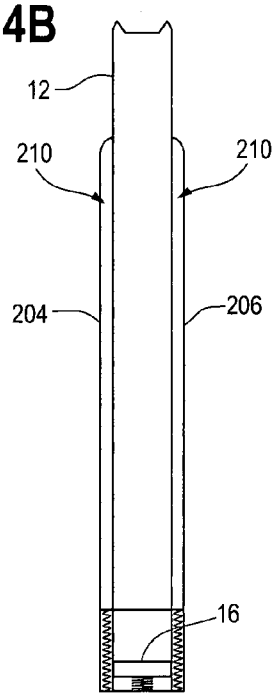
Figure 5A:
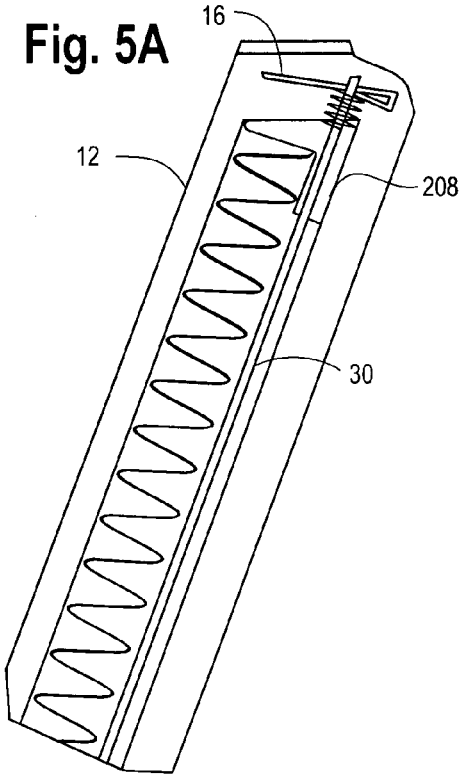
FIGS. 5*a–b* depict another alternate embodiment the ammunition clip of FIG. 1 in a fully loaded and in an empty configuration.
Figure 5B:
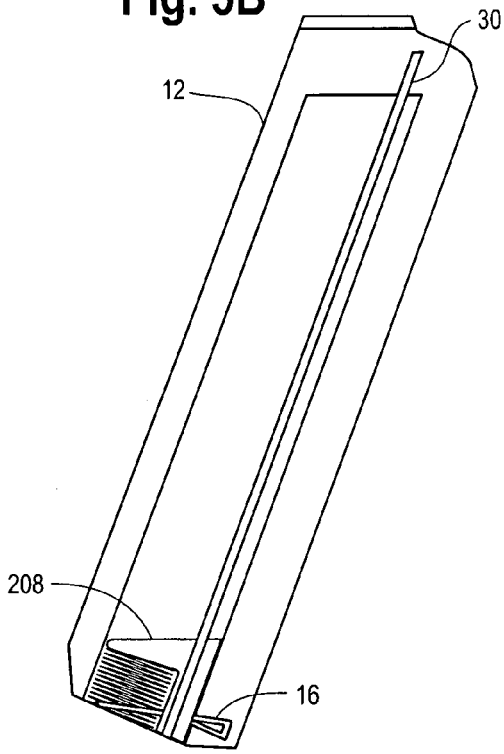

In another embodiment, illustrated in FIGS. 4*a*–*b* and 5*a*–*b*, a pair of primary springs 200, 202 are provided on opposing sides of the clip 10. In this regard, FIGS. 4*a*–*b* show cut-away end views of the clip 10 in both the empty state (FIG. 4*a*) and the full state (FIG. 4*b*). Similarly, FIG. 5*a* shows a cut-away side view of the clip 10 in the empty state and FIG. 5*b* shows a cut-away view of the clip 10 in the full state.

The primary springs 200, 202 may be a coil spring with a rectangular shape (each loop traces a rectangle) with appropriate dimensions (e.g., 12 mm on the long side of the rectangle and 2 mm on the short side). Each rectangular spring 200, 202 may be covered and protected during insertion into the gun 11 by a protective cover 204, 206 that forms a rectangular channel in the direction of spring travel. It should also be noted that the cover 204, 206 functions to substantially cover the slot 30 through which the primary spring is coupled to the movable carriage 16.

Figure 7A:
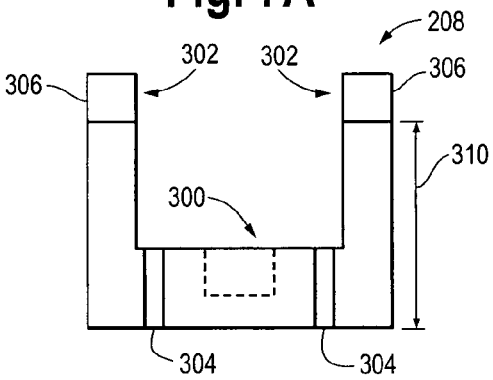
FIGS. 7*a–b* depicts a slide that may be used by the clip of FIGS. 4*a–b* and 5*a–b* under an alternate embodiment.
Figure 7B:
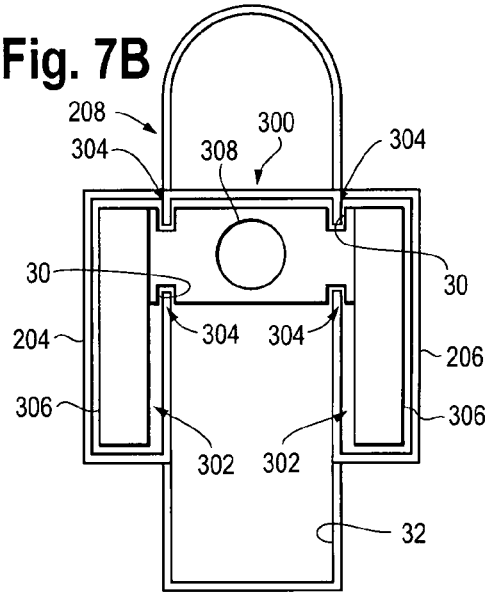

In the embodiment illustrated in FIGS. 4*a*–*b* and 5*a*–*b*, a slide 208 (FIGS. 7*a*–*b*) is provided that extends across the internal chamber 32, through slots 30 on opposing sides of the elongated housing 12 and engages the springs 200, 202 on opposing sides. FIGS. 7*a*–*b* depicts side and top views of the slide 208.

In general, the slide 208 includes a first secondary spring engagement portion 300 that lies inside the internal chamber 32 and a primary spring engagement portion 302 that is disposed outside the internal chamber 32 (inside the protective cover 204, 206). A set of slots 304 are provided in the slide 208 to engage the opposing sides of the slot 30 in the elongated housing 12.

The primary spring engagement portion 302 of the slide 208 is shown as rectangular to complement the loop dimensions of the spring 200, 202 and to fit inside the cover 204, 206. The primary spring engagement portion 302 also includes a primary spring peg 306 on each side that extends transversely across the primary spring channel 210 to engage the primary springs 200, 202.

The secondary spring engagement portion 300 includes a centrally located pocket 308 within the internal chamber 32 that receives a bottom end of the secondary spring 212. A top end of the secondary spring 212 engages the movable carrier 16.

During use, the clip 10 may be loaded to cause the clip to change from the state shown in FIGS. 4*a* and 5*a* to that of FIGS. 4*b* and 5*b*. As cartridges 17 are inserted into the clip 10, the cartridges 17 may cause the movable carrier 16 to begin moving downwards. As downward movement begins, the secondary spring 212 may begin to compress first. As more cartridges 17 are loaded the secondary spring 212 may press down on the pocket 308. The downward pressure on the pocket 308 causes downward force to be transferred to the primary spring pegs 306 in the primary spring channel 210 causing the primary springs 200, 202 to be compressed also.

In order to reduce the space required within the clip 10 for the springs, the distance 310 (FIG. 7*a*) may be chosen to equal the fully compressed distance of the springs 200, 202. The net result is that when the clip 10 is fully loaded, the bottom of the slide 208 bottoms out on the bottom of the clip 10. Similarly, the secondary spring 212 may be fully compressed into a recess in the bottom of the movable carrier 16 to further conserve space. The result is a clip 10 that fully maximizes the space for cartridges 17.

Figure 8A:
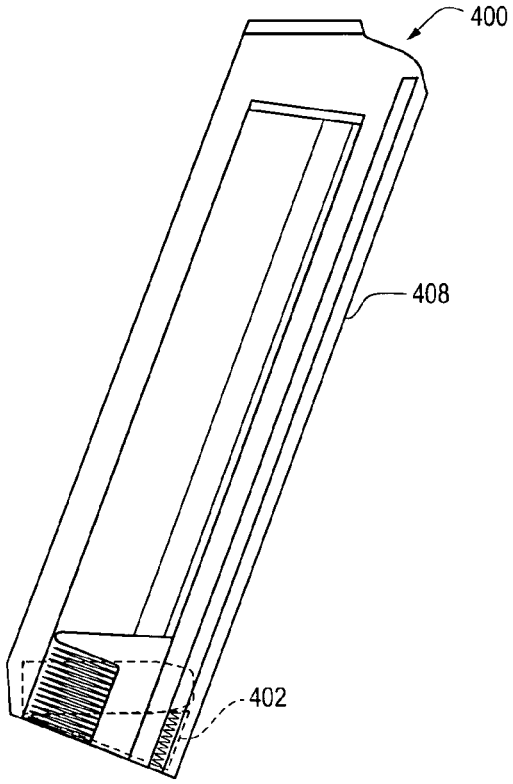
FIGS. 8*a–b* depict a side view of the clip of FIG. 1 under an alternate embodiment.
Figure 8B:
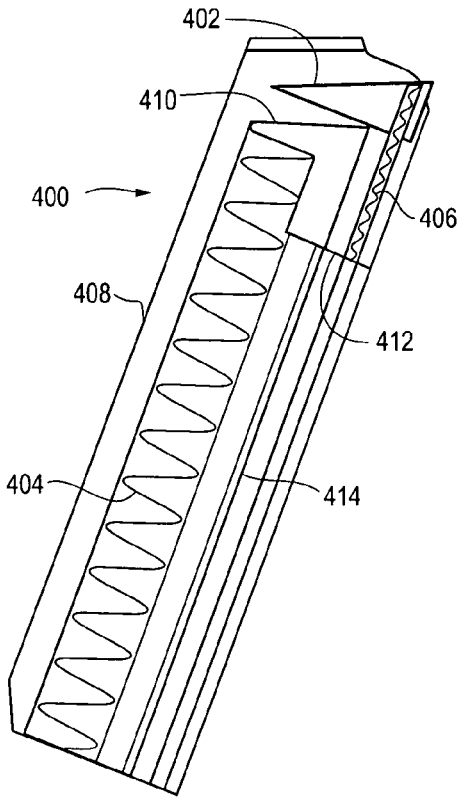

In another embodiment, the carrier may be modified to eliminate any need for a pocket for the secondary spring. FIGS. 8 and 9 show side and top views of a clip 400 under this alternate embodiment. As shown in FIG. 8 the primary springs 404 may be disposed within external primary spring housings disposed along either side of the clip 400. A slide 410 disposed within the primary spring housing engages the secondary spring 406 using a lateral member 412 that extends through a slot 414 in the elongated housing 408.

Figure 9A:
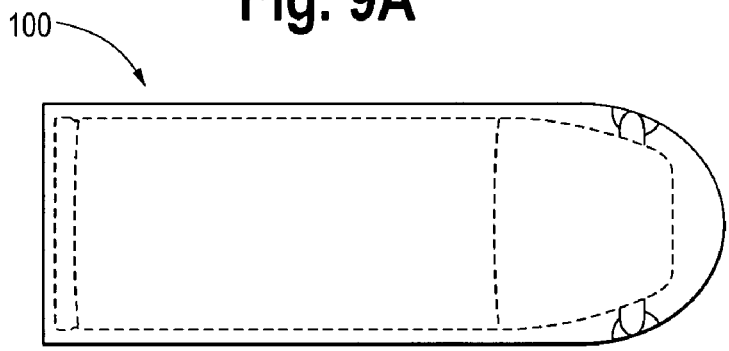
FIGS. 9*a–b* depict a top view of the clip of FIG. 8.
Figure 9B:
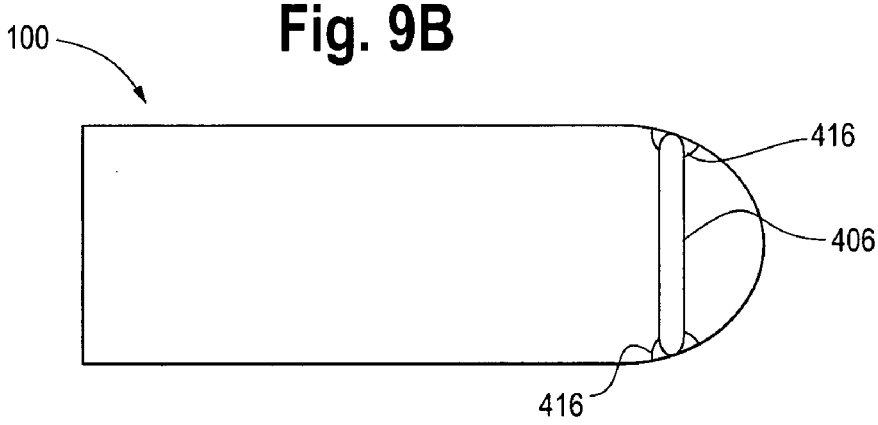

FIGS. 9*a*–*b* shows a top view of the clip 400. As shown in FIG. 9*b*, the secondary spring may be a coil spring with an elongated loop that engages a set of grooves 416 disposed on opposing sides of the internal chamber. The grooves 416 function to restrain the secondary spring, thereby giving the secondary spring 406 lateral support as the spring 406 is compressed or relaxed.

In still another embodiment of FIGS. 8 and 9, the grooves 416 of FIG. 9 are replaced with a pair of side slots that allow the secondary spring 406 to partially extend out of the internal chamber through the slots. In this case the slot 416 is eliminated and the lateral connector 416 extends through the side slots to connect the primary spring 416 to the secondary spring 406.

A specific embodiment of a novel ammunition clip has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An ammunition clip for supplying cartridges to a firearm, said ammunition clip comprising:

an elongated housing having an internal chamber configured to hold a plurality of laterally aligned cartridges entirely within the internal chamber, said elongated housing having a loading end and an opposing end;

a movable carriage disposed within the internal chamber for urging the aligned cartridges disposed between the moveable carriage and loading end along a longitudinal axis of the internal chamber towards the loading end;

a spring that urges the movable carriage towards the loading end, said spring being disposed completely outside the internal chamber and extending parallel to the longitudinal axis, but laterally offset from the internal chamber, said spring being coupled on a first end to the elongated housing and on a second end to the movable carriage and being operatable in a direction of spring pressure that is parallel to a longitudinal axis of the longitudinal housing.

2. The ammunition clip as in claim 1 wherein the spring further comprises a compression spring coupled on the first end to the opposing end of the elongated housing.

3. The ammunition clip as in claim 2 wherein the compression spring further comprises a coil spring.

4. The ammunition clip as in claim 1 wherein the elongated housing further comprises a longitudinal slot in a wall of the elongated housing that accepts a spring follower slide that extends through the slot to engage the movable carriage inside the internal chamber and the spring outside the internal chamber.

5. The ammunition clip as in claim 4 wherein the elongated housing further comprises a pair of longitudinal slots in opposing sidewalls of the elongated housing that accepts opposing ends of a transverse guide pin disposed in the movable carriage.

6. The ammunition clip as in claim 5 further comprising a secondary spring that connects the spring follower slide to the transverse pin of the movable carriage.

7. The ammunition clip as in claim 6 wherein the secondary spring further comprises a leaf spring.

* * * * *